United States Patent [19]

Tobias

[11] 4,161,906

[45] Jul. 24, 1979

[54] RADIAL PISTION PUMP OR MOTOR HAVING IMPROVED PORTING

[75] Inventor: Jaromir Tobias, New York, N.Y.

[73] Assignee: American Hydraulic Propulsion Systems, Inc., Englewood, N.J.

[21] Appl. No.: 858,561

[22] Filed: Dec. 8, 1977

[51] Int. Cl.[2] ..... F01B 13/06

[52] U.S. Cl. ..... 91/498

[58] Field of Search ..... 91/491, 492, 498

[56] References Cited

U.S. PATENT DOCUMENTS

| | | | |
|---|---|---|---|
| 1,696,139 | 12/1928 | Ferris | 91/492 |
| 2,823,619 | 2/1958 | May | 91/498 |
| 3,961,562 | 6/1976 | Rorsten | 91/492 |

FOREIGN PATENT DOCUMENTS

| | | | |
|---|---|---|---|
| 775853 | 5/1957 | United Kingdom | 91/498 |
| 1141855 | 2/1969 | United Kingdom | 91/498 |

*Primary Examiner*—William L. Freeh

*Attorney, Agent, or Firm*—Brumbaugh, Graves, Donohue & Raymond

[57] ABSTRACT

The efficiency of a radial piston hydraulic pump or motor is improved by making the ports in the block through which the hydraulic fluid flows from and back to the charge and discharge areas, respectively, of the pintle shaft asymmetrical about their centerlines in the axial direction, the area of the part of each port which lies on the side of the axial centerline remote from the supply and return passages in the pintle shaft being substantially greater than the area of the remaining part of the port. Similarly, the ports in the pintle shaft which communicate the charge and discharge areas to the ports in the block have greater areas in the portions thereof on the side of the axial centerline remote from the supply and return passages than in the portions on the side of the axial centerline nearer the supply and return passages. In addition the juncture between the bridge portion of the pintle shaft and the end wall which faces the supply and return passages is smoothly concavely curved, and the edge of each of the charge and discharge ports of the pintle shaft that is adjacent the supply and return passages is bevelled inwardly and axially in the direction from the circumferential outer surface toward the supply and return passages.

13 Claims, 8 Drawing Figures

RADIAL PISTION PUMP OR MOTOR HAVING IMPROVED PORTING

BACKGROUND OF THE INVENTION

Some relatively recent developments in the construction of radial piston hydraulic pumps and motors have led to greatly improved efficiency throughout a wider speed range and to a higher maximum operating speed capability. One such development is the radial piston hydraulic pump-motor described and shown in U.S. Pat. No. 3,709,104 granted Jan. 9, 1973 entitled "RADIAL PISTON HYDRAULIC PUMP OR MOTOR WITH LOW LOSS REACTION LINKAGE." The pump-motor described and shown in that patent uses Scott-Russell linkages between each of the pistons and the reaction assembly, thereby eliminating side loads between the pistons and cylinders and reducing friction losses and wear problems. Another improvement, one which has contributed both to greater efficiency and to greater speed capability, is described in Tobias U.S. Pat. No. 3,345,916 entitled "HIGH EFFICIENCY HYDRAULIC APPARATUS" granted Oct. 10, 1967. That patent involves an improvement in the porting of the pintle shaft and cylinder block which considerably reduces or eliminates a pressure drop/along the flow path from the charge area of the pintle shaft to each cylinder on the charge part of each piston stroke and a pressure rise along the path from each cylinder to the discharge area of the pintle shaft on the discharge part of each piston stroke, thereby greatly reducing turbulence, noise and cavitation. Tobias U.S. Pat. No. 3,548,719 entitled "HIGH EFFICIENCY RADIAL PISTON PUMP OR MOTOR WITH IMPROVED FLOW PATTERN" issued Dec. 22, 1970, describes a further improvement in the porting.

The latter two of the three patents mentioned above describe and show, more particularly, ports in the cylinder block which are elongated in the axial direction, each of which has, relative to the cylinders, a substantially lesser maximum circumferential dimension and greater maximum axial dimension. Preferably the cross-sectional area of each port in the cylinder block is substantially equal to the cross-sectional area of the cylinder bore, and the cross-sectional areas of the transfer passages between the ports and the cylinders are of uniform cross-sectional area throughout their lengths. Accordingly, there is no change in cross-sectional area in the flow path of fluid to and from the cylinders, and therefore, no significant drop in the hydrostatic pressure of the hydraulic fluid delivered to the cylinder or increase in pressure in the fluid returned from the cylinders. Moreover, the maintenance of a substantially uniform cross-sectional area throughout the extent of the transfer passages between the ports and cylinders reduces turbulence, noise and cavitation.

In all radial piston hydraulic pump-motors, the hydraulic fluid delivered to and discharged from the cylinders flows in the axial direction through a supply passage in the pintle shaft into a charge area and must turn through an angle of 90° in the charge area and transfer passage to enter the cylinder radially; the fluid then returns back through the transfer passage in the block to the discharge area of the pintle shaft and in so doing turns through another 90° angle for return through the return passage in the axial direction. The two 90° changes in flow direction that occur as a body or mass of fluid is first delivered to a cylinder and then returned from a cylinder during each cycle produces turbulence in the flow, and the turbulence, in turn, involves an energy loss as far as the torque output of the pump-motor is concerned and an energy exchange in the form of a loss of hydrostatic pressure and an increase in heat or thermal energy.

SUMMARY OF THE INVENTION

There is provided, in accordance with the present invention, a radial piston hydraulic pump-motor having improved porting which results in a reduction in losses due to turbulence in the fluid flow in the region extending generally from the respective supply and return passages in the pintle shaft to and from each cylinder. Like presently known radial piston hydraulic pump-motors, a pump-motor according to the present invention includes a pintle shaft which includes supply and return passages that extend in the axial direction through a portion of the shaft and open at one end into respective charge and discharge areas. A cylinder block mounted for rotation about the axis of the pintle shaft has a multiplicity of circumferentially spaced-apart, radial cylinders, each of which communicates by way of a transfer passage in the block and through a port opening at the inner bore of the block with the charge and discharge areas of the pintle shaft in sequence as the block rotates relative to the pintle shaft.

In accordance with one important aspect of the invention, each port in the block is asymmetrical with respect to its centerline in the axial direction, that part of the port which lies on the side of the axial centerline remote from the supply and return passages in the pintle shaft having an area substantially greater than the area of the remaining part of the port, i.e., the part of the area which lies on the side of the axial centerline nearer the supply and return passages in the pintle shaft. The increased areas of the parts of the ports in the block remote from the supply and return passages in the pintle shaft permit greater flow of hydraulic fluid to occur at the blind end of the pintle shaft; the increased area in the region remote from the ends of the passages is particularly advantageous on the charge side of the pintle bridge, the side of the pintle bridge from which in any particular mode of operation of the pump-motor hydraulic fluid is charged into those cylinders then communicating at a point in time with the charge area of the pintle shaft and in which each of the pistons is moving radially outwardly with respect to the axis of the pintle shaft as the block rotates relative to the shaft. On the charge side of the pump-motor the hydraulic fluid entering the charge area of the pintle shaft enters with a substantial momentum in the axial direction and tends to flow toward the downstream or blind end of the charge area where its flow is obstructed by the end wall of the charge area. With presently known porting arrangements, including those described and shown in U.S. Pat. Nos. 3,345,916 and 3,548,719 (referred to above), the impingement of the fluid against the blind end wall of the supply area of the pintle shaft has two important effects: first, the momentum of the incoming fluid tends to carry a larger part of the total flow entering the charge area to the downstream end of the charge area and produces a tendency toward backflow and uneven flow velocities in different parts of the total flow; second, the impingement of the fluid on the end wall of the charge passage, together with backflow and different velocities, produces a zone relatively intense turbulence in the region of the juncture between the end wall and the bridge of the pintle shaft. The first effect, that of backflow and different flow velocities within the total flow, through the charge area and the transfer passages in the block is somewhat related to the second effect, in that backflow and uneven flow is itself a form of turbulence that effects efficiency.

According to one aspect of the present invention, significant reductions in turbulence and, therefore, increased efficiency are obtained by providing an increased area at the downstream ends of the ports in the block which permits greater volumetric flow rates of fluid through the ports in the block at the downstream ends than the upstream ends. Thus, the tendency for fluid to flow toward the downstream end of the charge area is accommodated by an increased ability of the porting in the block to accept the fluid at the downstream end of the charge area of the pintle shaft, and the turbulence due to impingement of fluid on the downstream end of the charge area of the pintle shaft is also reduced, inasmuch as the flow stream pattern of fluid is changed significantly. In particular, the general pattern of the flow streams at the transition from axial flow to radial flow is moved in the downstream direction, thereby reducing the degree of confrontation of fluid with the end wall of the pintle shaft. The reduction in turbulence and smoother, more uniform flow of fluid in the transition region where the 90° turn occurs significantly improves efficiency by eliminating losses due to turbulence and backflow and is reflected in greater horsepower output and a reduction in heating of the hydraulic fluid in a given pump motor.

In a preferred embodiment of the invention each of the ports in the cylinder block is defined by lateral edges that diverge from each other in a direction away from the supply and return passages in the pintle shaft and a curved edge at each end joining the respective ends of the lateral edges. Stated in other terms, the edge of each port is defined geometrically by the line of intersection between the cylindrical inner surface of the block in a region radially outwardly of the charge and discharge areas and a non-circular cylindrical surface oriented with its axis perpendicular to the axis of rotation of the block and having side walls that diverge in a direction away from the supply and return passages and curved end walls joining corresponding ends of the side walls. The curvature of the end wall of the non-circular cylindrical surface nearer the supply and return passages is greater than the curvature of the end wall farther from the supply and return passages.

The improved porting in the cylinder block, as described above, is preferably coupled with an improved porting configuration in the pintle shaft. More particularly, each of the pintle shaft ports which open from the supply and discharge areas, respectively, has, with respect to its centerline in the axial direction, an area in that part that is on the side of the axial centerline remote from the supply and return passages greater than the area of that part lying on the side of the axial centerline nearer the charge and discharge passages. The porting in the pintle shaft permits a greater volumetric flow rate in the region remote from the supply and discharge passages, thus providing a further improvement in the flow pattern by permitting smoother flow and reducing turbulence in the charge and discharge areas. This aspect of the invention involves the orientation of the lateral walls of the ports in the pintle shaft, those lateral walls also defining the lateral edges of the pair of diametrically opposite land areas of a bridge portion of the pintle shaft. In a preferred embodiment, the lateral edges of the respective charge and discharge ports in the pintle shaft diverge in a direction away from the ends of the supply and return passages.

Further contributions to a smooth, relatively nonturbulent flow of fluid through the charge and discharge areas of the pintle shaft and the transfer passages in the block are provided, according to the invention, by smoothly concavely curved junctures between the bridge and the end wall of the pintle in the respective charge and discharge areas and by bevelled upstream edges of the walls of the pintle that define the charge and discharge ports, bevelled in a direction inwardly and axially toward the supply and return passages. Such modifications of the surfaces along which the fluid flows, though optional, are desirable.

For a better understanding of the invention, reference may be made to the following description of exemplary embodiments, taken in conjunction with the figures of the accompanying drawings.

DESCRIPTION OF EXEMPLARY EMBODIMENTS

Figure 1:
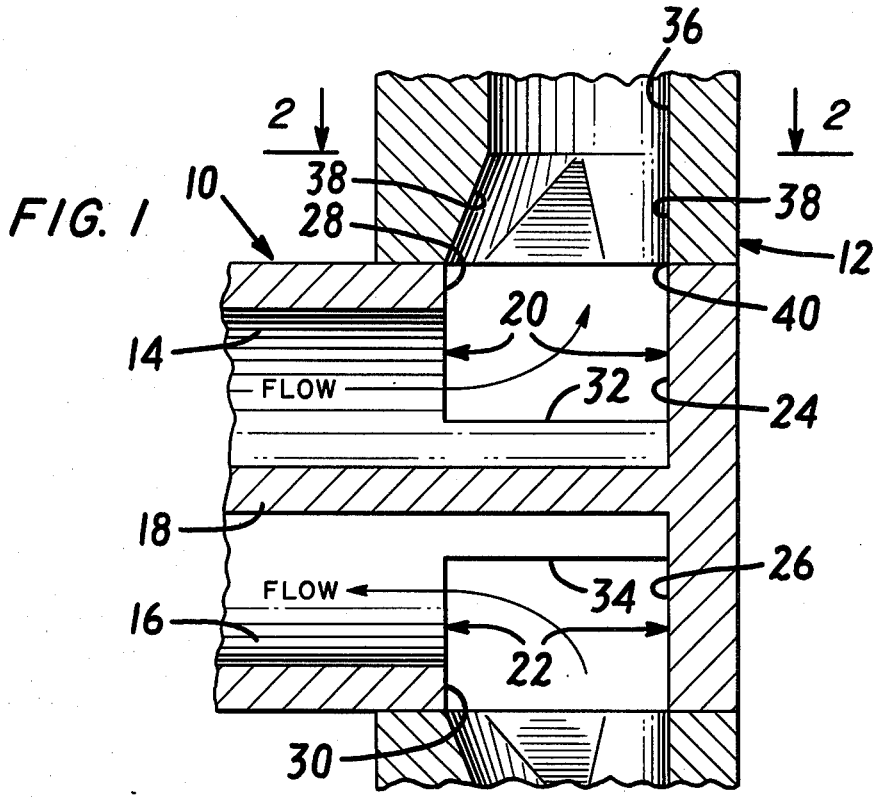
FIG. 1 is a schematic side cross-sectional view of a portion of the pintle shaft and portions of the block of a pump-motor embodying the present invention.

FIG. 1 illustrates schematically a pintle shaft 10 and a portion of a block 12 of a radial piston hydraulic pump-motor which is of the type shown, for example, in U.S. Pat. No. 3,709,104 (referred to above). The principles of the present invention may be employed in a variety of specific designs of radial pistion, hydraulic pump-motor, and therefore the drawings are in schematic form, inasmuch as they are intended to illustrate the principles and show particular features only insofar as the porting arrangements are concerned. A typical pintle shaft of a radial piston hydraulic pump-motor has a circular cylindrical outer surface and supply and return passages 14 and 16 which extend coextensively parallel to the axis of the shaft and are separated from one another by a transverse wall or bridge 18. The passages 14 open at their ends within the pintle shaft 10 to charge and discharge areas 20 and 22, which are defined by the bridge 18 and by end walls 24 and 26. The charge and discharge areas 20 and 22 of the pintle shaft open radially outwardly through charge and discharge ports 28 and 30 in the circumferential wall of the shaft. The lateral edges 32 and 34 of the charge and discharge areas also constitute the lateral edges of a pair of diametrically opposite land areas of the pintle shaft (only one of which is visible in FIG. 1).

The block 12 is an annular member that is suitably mounted for rotation about the axis of the pintle shaft (see, for example, U.S. Pat. No. 3,709,104) and has an inner circular cylindrical surface having a diameter slightly greater than the diameter of the outer surface of the pintle shaft, the clearance being sufficient to permit controlled leakage of hydraulic fluid for lubrication purposes but to restrict leakage as much as possible. The radial outer portion of the block includes several circumferentially spaced apart cylinder bores 36, each of which extends radially with respect to the axis of rotation of the pintle shaft and receives a piston. As is apparent from the prior patents referred to above, the configurations of the pistons and cylinders may involve either pistons which slide within internal cylindrical surfaces of the cylinders or cup-like pistons which work along external cylindrical surfaces of the cylinders. Each cylinder 36 communicates in sequence, as the block 12 rotates, with the charge and discharge areas 20 and 22 of the pintle shaft through a transfer passage 38 that extends from the cylinder and opens through a port 40 in the inner circumferential surface of the block.

Figure 2:
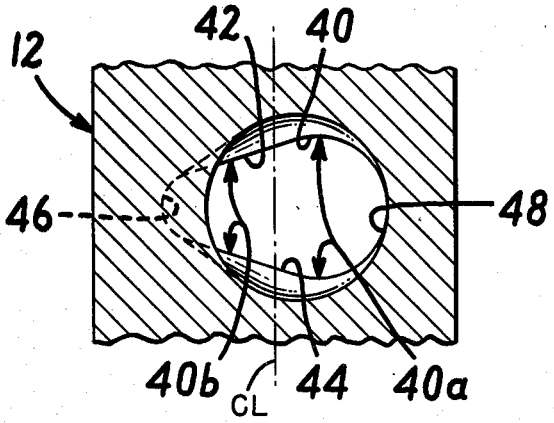
FIG. 2 is a schematic view showing the configuration of a transfer passage in the block of the embodiment of FIG. 1, the view being taken generally along the lines 2—2 of FIG. 1 and in the direction of the arrows.

As shown in FIG. 2 each port 40 in the block 12 is asymmetrical with respect to its centerline CL in the axial direction, and the part **40*a* of the port 40 lying on the side of the centerline CL remote from the charge and discharge passages 14 or 16 has an area that is substantially greater than the area of the remaining part 40*b*. To this end, the port 40 includes lateral edges 42 and 44 which diverge from each other in a direction away from the supply and return passages 14 and 15 and curved end edges 46 and 48 adjoining the respective adjacent ends of the lateral edges 42 and 44. In the embodiment shown in the drawing, the end walls are arcuate, but they need not be. In any case, the curvature, whether uniform or variable, of the end wall 46 nearer the supply and return passages 14 and 16 is substantially greater than the curvature of the end wall 48** that is remote from the supply and return passages.

Figure 3:
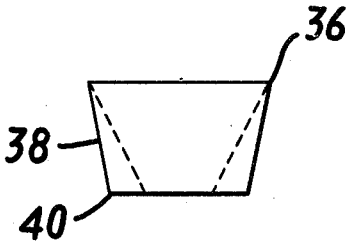
FIG. 3 is a schematic developmental end view of the transfer passage in the block of the pump-motor shown in FIG. 1.
Figure 4:
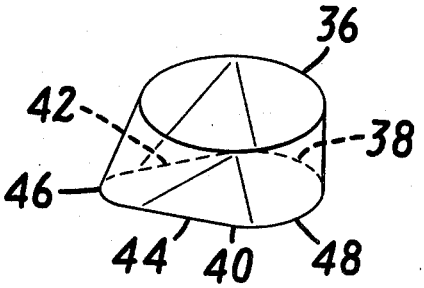
FIG. 4 is a side pictorial developmental view taken from slightly above and in schematic form of the transfer passage of the block of the pump-motor of FIG. 1.
Figure 5:
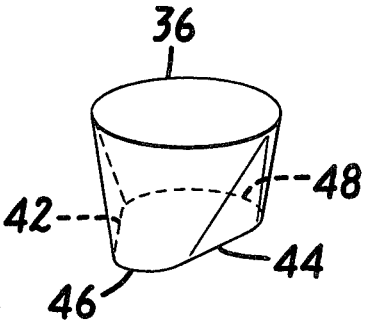
FIG. 5 is a ¾ pictorial view (also schematic and developmental in form) of the transfer passage in the block of the pump-motor of FIG. 1.

In the interest of clearly illustrating the configuration of the transfer passages 38, FIGS. 3, 4 and 5 (which are developmental views of a surface rather than actual views) depict somewhat schematically the bounding surface of the transfer passage as if the passage were a solid body bounded by a wall; in other words the outer surfaces of the members shown in FIGS. 3, 4 and 5 match the inner wall within the block that defines each transfer passage 38. Moreover, the illustrations of the port 40 and the transfer passage 38 in FIGS. 1 through 5 are simplified for clarity by not showing the circumferential curvatures.

The port 40 is defined by the line of intersection between the cylindrical inner surface of the block 12 and a non-circular cylindrical surface that is oriented radially with respect to the axis of the pintle shaft and has side walls that diverge from each other and curved end walls joining the side walls; the cross-section of the non-circular cylindrical surface, in other words, matches in shape that of the port 40 as it is shown in FIG. 2 of the drawings. It will be understood that a true orthogonal projection of the port, as viewed along its axis, will, by reason of the curvature of the block, differ slightly from the view shown in FIG. 2. It is not intended, however, by the foregoing description to overemphasize the particular shape of the port. What is important, is that with respect to the axial centerline, the portion of each port remote from the supply and return passages 14 and 16 be greater than that of the portion nearer the supply and return passages and that the edges of the port have reasonable continuity in shape.

As may best be seen in FIGS. 3, 4 and 5 of the drawings, the walls of each transfer passage 38 are defined by lines or elements that, extend straight between the port 40 (which can be thought of as being of a tear drop shape) and an inner end of the circular cylindrical walls of the cylinder 36. It is preferable, as described in Tobias U.S. Pat. No. 3,345,916, that the cross-sectional area of the port 40 be substantially equal to the cross-sectional area of the cylinder 36 and the cross-sectional area throughout the axial extent of the transfer passage 38 be uniform.

Figure 6:
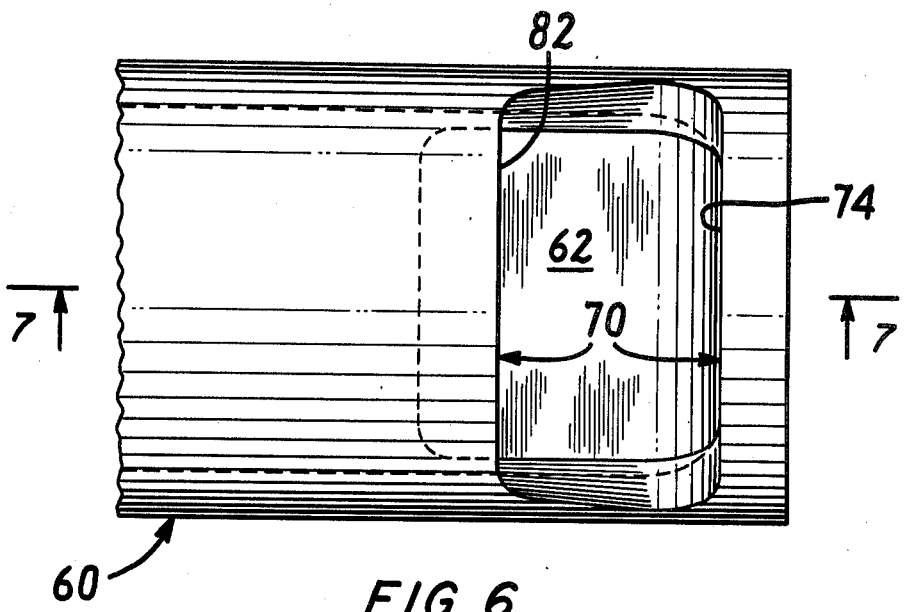
FIG. 6 is a top view of a modified pintle shaft, the illustration being generally schematic in form.
Figure 7:
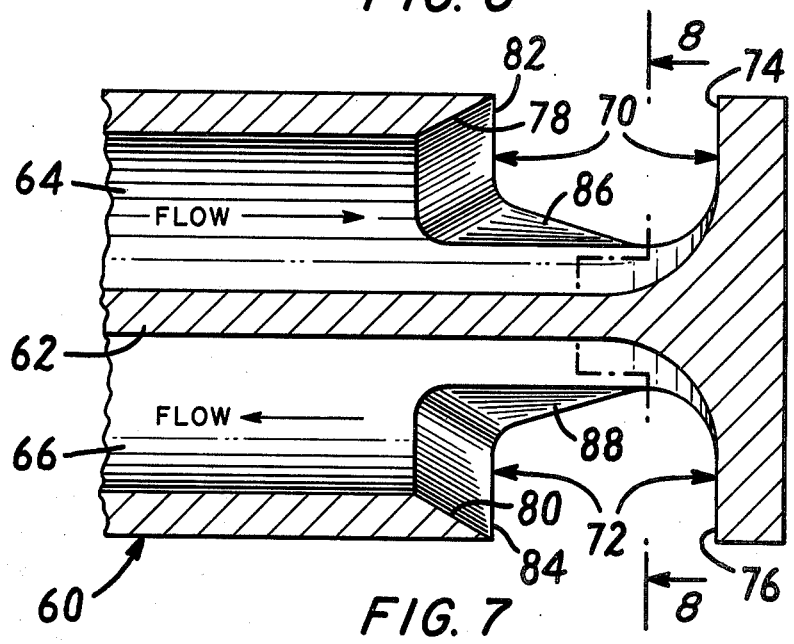
FIG. 7 is a side cross-sectional view of the pintle shaft shown in FIG. 6.
Figure 8:
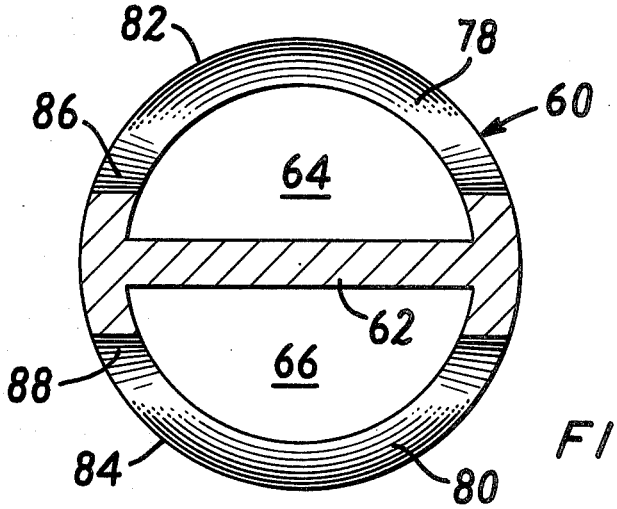
FIG. 8 is an end cross-sectional view of the pintle shaft shown in FIGS. 6 and 7, the section being taken generally along a plane represented by the lines 8—8 of FIG. 6.

FIGS. 6, 7 and 8 of the drawings illustrative another embodiment of the pintle shaft 60, which, when used in conjunction with a block having the porting described above and shown in FIGS. 1 to 5, permits additional improvements in the flow of hydraulic fluid through the charge and discharge areas and the transfer passages. The pintle shaft 60 shown in FIGS. 6 to 8 includes a diametrically extending bridge 62 that divides the hollow shaft into a supply passage 64 and return passage 68, each of generally semi-circular cross-section, which open into supply and discharge areas 70 and 72, respectively. The end walls 74 and 76 of the charge and discharge areas remote from and facing the ends of the supply and return passages 64 and 66 form junctures with the bridge 62 that are concavely smoothly curved, thus to present guiding surfaces for the fluid flow in the ends of the areas 70 and 72 which generally conform to the flow streams of the fluid at the juncture, and that significantly reduce turbulence. The edges 78 and 80 of the charge and discharge ports 82 and 84, respectively, that are adjacent the ends of the supply and discharge passages are bevelled inwardly and toward the ends of the passages, thus to provide a smooth transition in the flow as it turns direction between the passages 64 and 66 in the pintle shaft and the transfer passages in the block (see FIG. 1).

The lateral walls 86 and 88 of the pintle ports 82 and 84, respectively, which also define the edges of the land areas of the pintle shaft between the ports, diverge from each other in a direction away from the supply and return passages 64 and 66. Accordingly, each pintle port 82 and 84 has, with respect to its axial centerline CL, an area in the part that lies on the side of the centerline remote from the supply and return passages that is substantially greater than the area of the part that lies on the side of the centerline nearer the passages. The lateral edges of the ports 86 and 88 are increasingly bevelled in and toward the bridge in regions closer to the passages, thus to provide a smooth transition between them and the bevelled edges 78 and 80 of the pintle wall adjacent the passages 64 and 66.

By comparing FIGS. 1 and 6 it will be observed that the configuration of each port in the block is such that as each port in the block moves off the land area and opens to the charge area of the pintle, the opening will occur gradually beginning at a small area at the widest part of the port in the block and progressively opening along the larger curved wall and along the lateral wall.

In other words the opening of each port in the block to the pintle occurs gradually and smoothly. It is believed that the gradual opening of each port as it emerges from the land area and opens to the charge area of the pintle reduces turbulence, noise and cavitation, as compared to ports in the block that have parallel, lateral edges and that open rather abruptly entirely along their lengths in the axial direction, as is the case with the ports shown in the Tobias U.S. Pat. No. 3,345,916 and 3,549,179. The pintles of both FIG. 1 and FIGS. 5 to 7 provides the gradual opening just described. Similarly, the ports close gradually and smoothly at the end of the working stroke of web piston, and smooth opening and closing takes place on the discharge side as well.

I claim:

1. In a radial piston hydraulic pump or motor which includes a pintle shaft having supply and return passages communicating from one end thereof with charge and discharge areas that open radially outwardly through charge and discharge ports in the pintle shaft and a cylinder block mounted for rotation about the axis of the pintle shaft, the cylinder block including a multiplicity of circumferentially spaced-apart radial cylinders each of which communicates in sequence with the charge and discharge ports of the pintle shaft by way of a transfer passage in the block which has a port adjacent the pintle shaft, the improvement wherein each transfer passage port is asymmetrical with respect to the centerline thereof in the axial direction, the area of the part of each transfer passage port which lies on the side of the axial centerline remote from the supply and return passages being substantially greater than the area of the remaining part of the port.

2. The improvement according to claim 1 wherein the medial portion of the port has lateral edges that diverge in a direction away from the supply and return passages and a curved edge at each end joining the respective ends of the lateral edges.

3. The improvement according to claim 1 wherein each port is defined geometrically by the line of intersection between the cylindrical inner surface of the block in the region radially outwardly of the charge and discharge areas of the pintle shaft and a non-circular cylindrical surface oriented with its axis perpendicular to the axis of rotation of the block and having sidewalls that diverge in a direction away from the ends of the supply and return passages and curved end walls joining the respective sidewalls, the curvature of the end wall of the non-circular cylindrical surface nearer the supply and return passages being greater than that of the end wall farther from the supply and return passages.

4. The improvement according to claim 1 wherein with respect to its centerline in the axial direction, each charge and discharge port of the pintle shaft has an area on the side of such centerline remote from the ends of the supply and return passages that is substantially greater than the area thereof on the side of centerline nearer the supply and return passages.

5. The improvement according to claim 4 wherein the charge and discharge ports have lateral walls which also define the lateral edges of a pair of diametrically opposite land areas of a bridge portion of the pintle shaft and wherein the lateral edges of the respective charge and discharge ports diverge in a direction away from the supply passages of the pintle shaft.

6. The improvement according to claim 1 wherein the pintle shaft includes an end wall portion that is joined to a bridge portion and has a pair of surfaces spaced from the bridge portion and generally facing the supply and return passages and defining in part the charge and discharge areas, and wherein the juncture between the bridge portion and the said surfaces is smoothly concavely curved.

7. The improvement according to claim 1 wherein each charge and discharge area of the pintle shaft is defined in part by a concave smoothly curved surface which joins the respective surfaces of a bridge portion to a surface of an end wall of the pintle shaft which is spaced from the bridge portion and generally faces the supply and return passages.

8. The improvement according to claim 1 wherein each of the charge and discharge ports has a circumferentially extending edge adjacent the respective supply and return passages, each such edge being bevelled inwardly from the circumferential surface of the pintle shaft and axially in a direction toward the respective supply or return passage.

9. In a radial piston hydraulic pump or motor which includes a pintle shaft having supply and return passages communicating from one end thereof with charge and discharge areas that open radially outwardly through charge and discharge ports in the pintle shaft and a cylinder block mounted for rotation about the axis of the pintle shaft, the cylinder block including a multiplicity of circumferentially spaced-apart radial cylinders each of which communicates in sequence with the charge and discharge ports of the pintle shaft by way of a transfer passage in the block which has a port adjacent the pintle shaft, the improvement wherein with respect to its centerline in the axial direction, each charge and discharge port of the pintle shaft has an area on the side of such centerline remote from the ends of the supply and return passages that is substantially greater than the area thereof on the side of centerline nearer the supply and return passages.

10. The improvement according to claim 9 wherein the charge and discharge ports have lateral walls which also define the lateral edges of a pair of diametrically opposite land areas of a bridge portion of the pintle shaft and wherein the lateral edges of the respective charge and discharge ports diverge in a direction away from the supply passages of the pintle shaft.

11. The improvement according to claim 10 wherein the pintle shaft includes an end wall portion that is joined to a bridge portion and has a pair of surfaces spaced from the bridge portion and generally facing the supply and return passages and defining in part the charge and discharge areas, and wherein the juncture between the bridge portion and the said surfaces is smoothly concavely curved.

12. The improvement according to claim 10 wherein each charge and discharge area of the pintle shaft is defined in part by a concave smoothly curved surface which joins the respective surfaces of a bridge portion to a surface of an end wall of the pintle shaft which is spaced from the bridge portion and generally faces the supply and return passages.

13. The improvement according to claim 10 wherein each of the charge and discharge ports has a circumferentially extending edge adjacent the respective supply and return passages, each such edge being bevelled inwardly from the circumferential surface of the pintle shaft and axially in a direction toward the respective supply or return passage.

* * * * *